United States Patent [19]

Walker

[11] 4,411,344

[45] Oct. 25, 1983

[54] CARRIER FOR GARMENT BAGS AND THE LIKE

[76] Inventor: Brooks Walker, 1280 Columbus Ave., San Francisco, Calif. 94133

[21] Appl. No.: 340,280

[22] Filed: Jan. 18, 1982

Related U.S. Application Data

[63] Continuation-in-part of Ser. No. 268,901, Jun. 1, 1981, and a continuation-in-part of Ser. No. 293,364, Aug. 17, 1981, Pat. No. 4,354,583, and a continuation-in-part of Ser. No. 310,636, Oct. 13, 1981.

[51] Int. Cl.[3] ..... A45C 5/14

[52] U.S. Cl. ..... 190/18 A; 280/47.26

[58] Field of Search ..... 190/18 A; 280/37, 47.26, 280/47.24

[56] References Cited

U.S. PATENT DOCUMENTS 4,262,780 4/1981 Samuelian ..... 190/18 A

*Primary Examiner*—Donald F. Norton

[57] ABSTRACT

A carrier for use with a foldable garment carry-on bag includes a frame within the lower half of the bag. The frame extends through the bottom of the bag and is provided with a wheeled axle. In one embodiment of the invention the upper half of the bag is also provided with a frame to obviate the usual transversely extending stiffeners and to permit securing the folded bag by a single central fastener rather than the two or four fasteners usually used on such bags.

9 Claims, 14 Drawing Figures

10
11
12
14
16

18
20
22
24
26
30
32
34
36
38
40
46
48
50
56
60
62
64

52
54
56
58

36
40
42
46
4
4
50
56
60
62
64

18
20
22
24
26
66
68
70
72
74
76

80
82
83
84
86
88
94
98
100
102

83
84
86
88
90
92

Fig 8
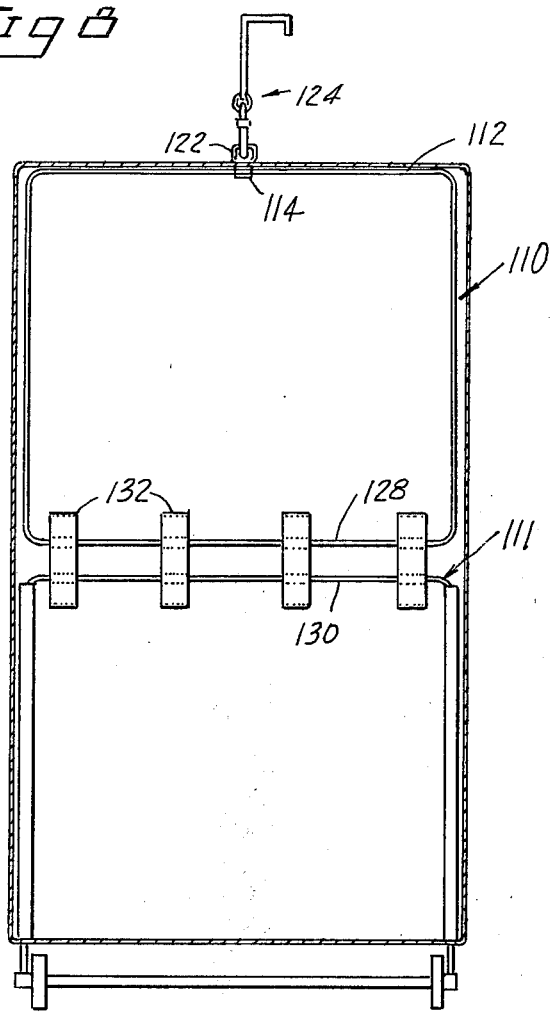
Fig 14
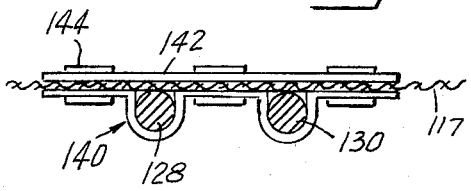
Fig 9
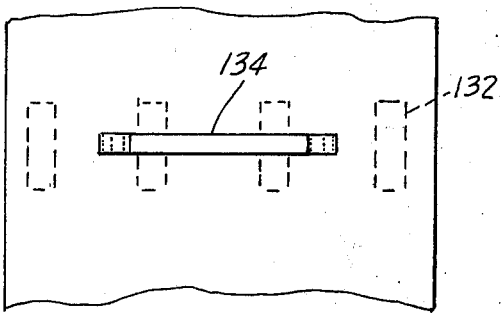
Fig 12
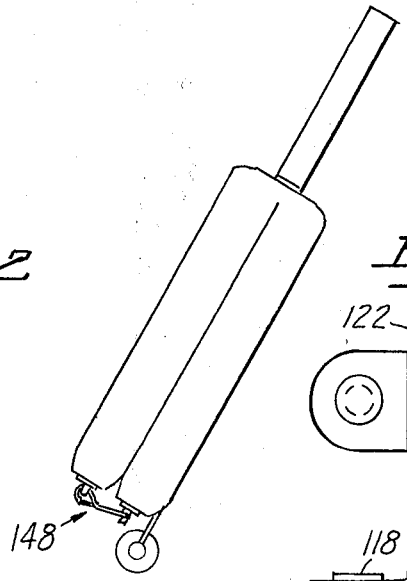
Fig 10
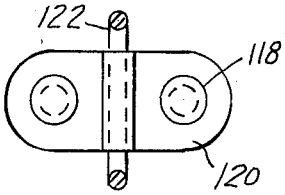
Fig 13
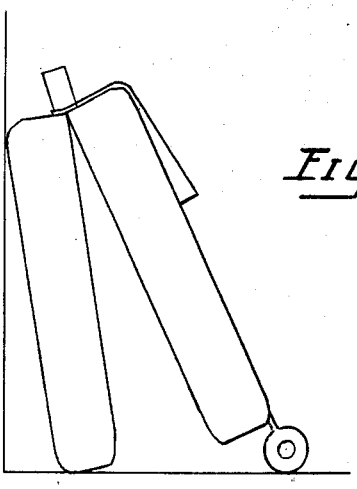
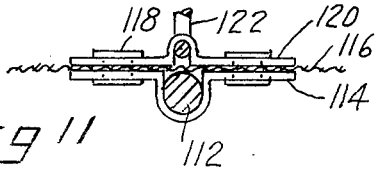
Fig 11

CARRIER FOR GARMENT BAGS AND THE LIKE

This application is a continuation-in-part of Ser. No. 268,901 filed June 1, 1981; Ser. No. 293,364 filed Aug. 17, 1981 now U.S. Pat. No. 4,354,583; and Ser. No. 310,636 filed Oct. 13, 1981.

This invention relates to a carrier particularly adapted for use with a garment carry-on bag of the type commonly employed by airplane passengers.

In the above noted applications wheeled carriers were disclosed for carrying garment bags in their elongated folded out condition which is preferable in many instances. In other situations, however, it is preferable to be able to wheel the garment bag with the latter in its folded condition.

The main object of the present invention is the provision of a wheeled carrier for garment bags which permits the bag to be wheeled in its folded condition. In this manner the bending stresses on the side members on the frame are reduced since more weight is transferred to the wheels than in the unfolded condition. Also this permits the bag to be towed by the usual longer shoulder strap rather than a longer towing handle on a stiff arm.

Another object is to permit securing the bag in its folded condition by a single fastener near the center of the side near the axle and between the wheels.

Another object is to use the frame in the lower half of the bag or the frame in both halves of the bag to eliminate the need for a stiffener at the center of the folded bag to support the center handle or the ends of the shoulder carrying strap.

Another object of the invention is the provision of an inexpensive carrier which may be readily applied to most garment bags and used in an efficient manner.

Still another object is to provide a carrier which is extremely light in weight.

Yet another object is the provision of a frame for use with a garment bag carrier which obviates the usual flat bar stiffeners which extend transversely of the bag in most cases.

Other objects and advantages will be apparent from the following specification and drawings:

FIG. 8 is a view similar to FIG. 2 showing another modified form with the front side of the bag removed.

FIG. 9 is a view similar to FIG. 8 but showing a portion of the rear side of the bag.

FIG. 10 is a plan view of the assembly support.

FIG. 11 is cross section through the support of FIG. 10.

FIG. 12 is an end view of the garment bag of FIGS. 8,9 but with the bag in folded condition and in position for being wheeled.

FIG. 13 is an end view of the folded garment bag positioned against a wall.

FIG. 14 is a view similar to FIG. 11 showing an alternative method of hingedly securing the frames of FIG. 8.

Figure 1:
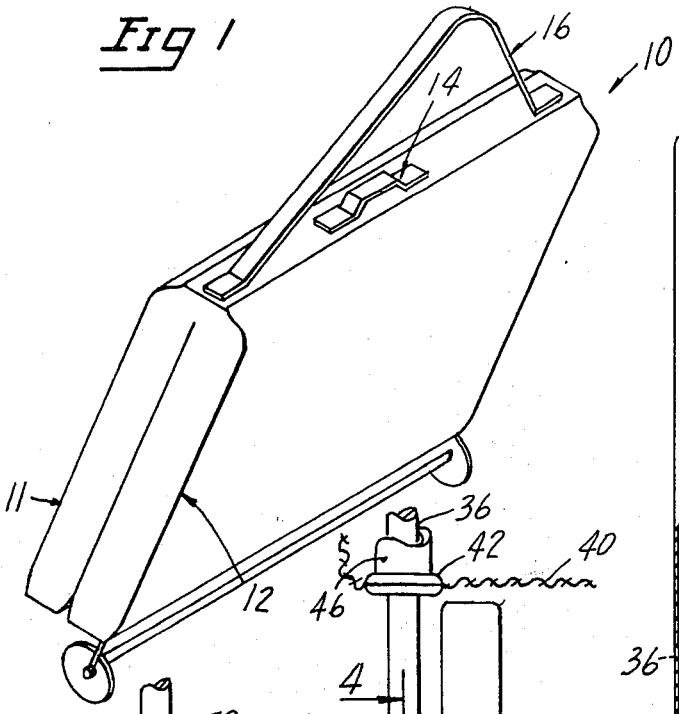
FIG. 1 is an isometric view of a folded garment bag with the invention applied.

In FIG. 1 a conventional garment bag formed of textile material is generally designated 10 having at top half 11 and a bottom half 12 and folded over to permit carrying the same by either a handle 14 or a shoulder strap 16.

Figure 2:
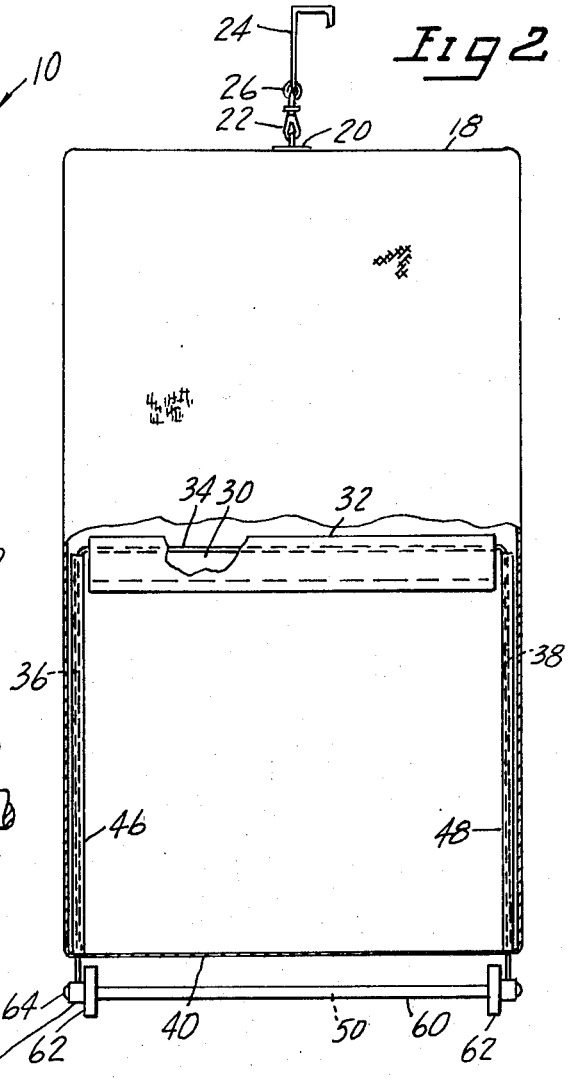
FIG. 2 is a side elevation of the garment bag of FIG. 1 in its unfolded condition with the lower portion thereof broken away to show internal structure.

In FIG. 2 the same garment bag is shown in its elongated unfolded condition with the top wall 18 provided with a staple 20, swivel 22 and hook 24 connected to swivel 22 by a ring 26.

As seen in FIG. 2 a transversely extending flat bar stiffener 30 of wood, aluminum, or other light weight material is stitched in place by means of a rectangular length of stitchable fabric 32. This stiffener provides a base to which handle 14 and strap 16 may be secured as by stitching screws, rivets or the like.

Figure 3:
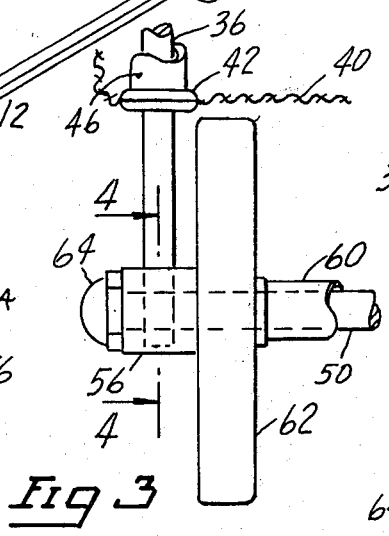
FIG. 3 is a greatly enlarged fragmentary view of the wheel portion of the bag.

By the present invention a light weight frame, preferably of spring steel, is provided having a transversely extending portion 34 fitted within the pocket formed by the stitched material 32. Bent at right angles to portion 34 are a pair of parallel side portions 36,38 which extend at their lower ends through the bottom wall 40 of the bag. As best seen in FIG. 3 grommets 42 may be applied to the material of the bottom wall 40 to receive said side portions therethrough.

In order to place the side members 36,38 in tension so as to apply pressure to the bottom wall 40 of the bag to retain its proper shape, light weight tubes 46,48 are applied around side members 36,38 as best seen in FIG. 2. Since said tubes 46,48 abut the cross piece 34 at one of their ends and the botom wall 40 of the bag at their opposite ends it will be apparent from FIG. 2 that by making the length of said tubes of a length sufficient to place them in compression the side members 36,38 will be in tension and the longitudinally extending sidewalls of the bag will also be in tension so as to retain the desired shape of the bag.

Figure 4:
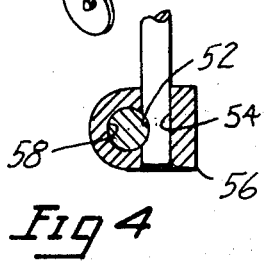
FIG. 4 is a cross section taken in a plane indicated by lines 4—4 of FIG. 3.

The present invention contemplates the use of very light weight material such as 3/16" diameter spring steel or metal tubing for use in forming the above described frame. Said frame includes a wheeled axial 50 extending between the outer ends of side members 46,48. In view of the fact that spring steel is too hard to be threaded by most tools a groove 52 may be formed by grinding at the outer end of each member. Said outer end of each side member is passed into a bore 54 formed in a block 56 (FIGS. 3,4) and said block is formed with a second bore 58 extending at right angles to bore 54 and receiving the axle 50 therein. As best seen in FIG. 4 said bores are formed so that axle 50, which may be of mild steel, is partially received in the groove 52 thus fixedly securing the side member in place relative to the axle 50.

Surrounding the axle 50 is an elongated tube 60 of plastic or other light weight material which serves to space apart wheels 62. The outer ends of axle 50 may be threaded to receive nuts 64 to complete the assembly. To reduce the overall length of the axle assembly the nuts 64 may be omitted and the outer one half of blocks 56 may be threaded—one with a right hand thread and the other with a left hand thread. This structure makes for a simple assembly.

Figure 5:
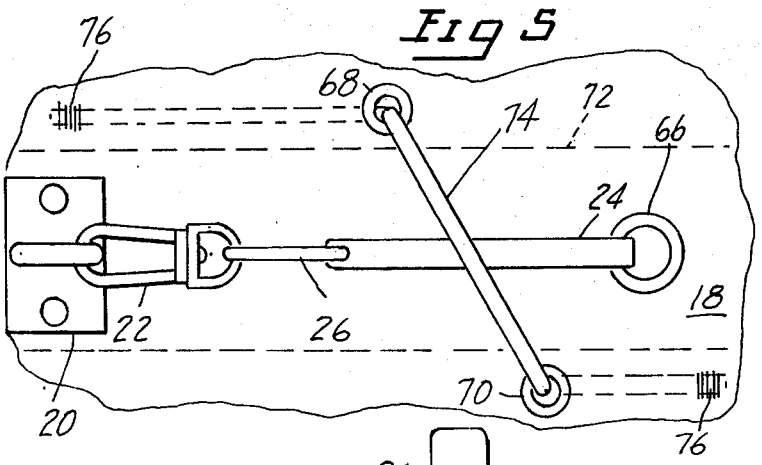
FIG. 5 is a fragmentary view of the top of the garment bag showing the means for securing the hook in stored condition.

In order to hold hook 24 in place and prevent it from dragging on the ground while the bag is being wheeled a grommet 66 is preferably applied to top 18 of the bag so as to receive therein the outer end of hook 24 as seen in FIG. 5. Two additional grommets 68,70 may be applied at the opposite sides of top stiffener 72 to receive a stitchable shock cord 74 therethrough. This cord 74 is stitched at its opposite ends to top 18 as indicated at 76 so that sufficient length of cord is provided to allow the user to stretch the shock cord out of the bag enough to allow release of the hook 24.

Figure 6:
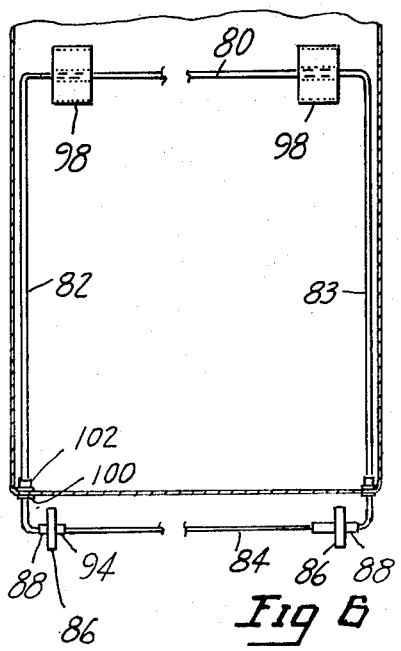
FIG. 6 is a side elevation partly broken away of the bottom half of a garment bag showing a modified form of frame.
Figure 7:
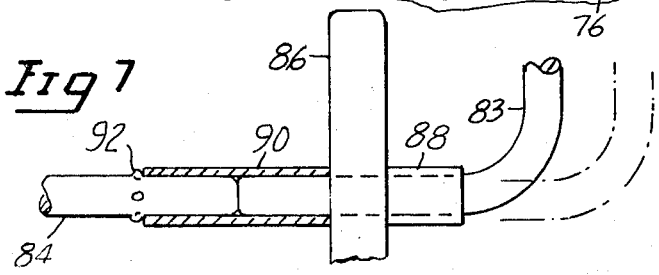
FIG. 7 is an enlarged fragmentary view of a portion of the frame of FIG. 6.

Another form of frame is shown in FIGS. 6,7. In this case the entire frame, including the axle, if formed from one length of mterial which is preferably 3/16" diameter spring steel. As best seen in FIG. 6 a spring steel rod is bent to provide an upper transverse section 80, side members 82,83 and axle portion 84.

As best seen in FIG. 7 the ends of the length of spring steel forming the frame are in abutment at a point adjacent the right hand wheel 86 with the two wheels 86 rotatably supported on the axle portion. A short sleeve 88 is crimped or otherwise secured to axle 84 adjacent the lower corner and a longer sleeve 90 connects the adjacent ends of the rod forming the frame. The axle portion 84 is upset adjacent sleeve 90 as indicated at 92 so as to secure the right hand wheel 86 against lateral movement. As seen in FIG. 6 the left hand wheel 86 may be positioned in place by a short sleeve 88 as indicated above and another short sleeve 94—both of said sleeves being fixedly secured to the axle portion.

Referring to FIG. 6, it is seen that the inner transverse section 80 of the frame is secured to the garment bag adjacent the transverse fold line of the latter by means of rectangular sections 98 of fabric which is stitched or otherwise secured to the fabric of the bag.

At the lower end of the bag, grommets 100 may be secured to the side members 82,83 (FIG. 6) at the points at which said members pass through the bottom of the bag and ferrules or sleeves 102 may be fixedly secured to said side members by crimping or adhesive to place the side members 82,83 under a slight compression to maintain the shape of the bag by placing the longitudinally extending side members in tension.

The embodiment of FIGS. 6,7 has the advantage of simplicity of manufacture and permitting the wheels 86 to be positioned so as to obviate snagging with adjacent articles. Furthermore this form of the invention permits the elimination of the usual rectangular transverse stiffener which is replaced by transverse section 80 of the frame.

Another form of the invention is shown in FIGS. 8–13. In this case upper and lower rectangular frames generally designated 110,111 are provided in the upper and lower halves of the bag. The upper transverse member 112 of frame 110 is secured by means of a flanged retainer 114 (FIGS. 10,11) to the top 116 of the bag and is connected by means of rivets 118 to an outer retainer 120 which in turn serves to swingably secure a ring 122 of the hook assembly generally designated 124.

The lower transverse portion 128 of frame 110 and the upper transverse portion 130 of frame 111 are swingably secured to the bag adjacent its central fold line by rectangular sections 132 of fabric which may be stitched or riveted to the fabric of the bag. In this manner the usual transverse stiffener may be obviated and sufficient support is provided for handle 134 (FIG. 9).

Another method of securing the adjacent transverse portions of the frames is shown in FIG. 14 wherein a clip 140 is formed to swingably receive the frame portions 128,130 and is clamped to the fabric 117 of the bag by means of a flat bar 142 and rivets 144.

The use of the two frames shown in FIG. 8 adds greatly to the stiffness of the two halves of the bag so that said two halves may be adequately held together by only one fastener such as hood 148 in FIG. 12. In addition the added stiffness allows the partially open bag to be supported against a wall for example as seen in FIG. 13.

It should also be noted that the elimination of three side fasteners and the usual two transverse stiffeners goes a long way in compensating for the added frames. In addition the single fastener of FIG. 12 speeds up the loading in a plane when the bag is to be stored in its unfolded condition.

I claim:

1. In combination with a generally rectangular elongated garment bag adapted to be folded on itself along a transverse fold line, a carrier for said bag comprising:

a frame including a top transverse portion extending substantially along said fold line, and a pair of side members extending longitudinally of said bag and connected to said transverse portion, means securing said frame to said bag with said side members extending through the bottom of said bag, and a wheeled axle extending between the projecting ends of said side members.

2. A carrier according to claim 1 wherein said transverse portion, said side members and said axle are formed from a unitary length of rod.

3. A carrier according to claim 1 wherein said bag includes a hook connected to the top of said bag and means for securing said hook to the top of said bag when the latter is in folded condition.

4. A carrier according to claim 1 wherein a second frame is secured to said bag within the upper half of the latter.

5. A carrier according to claim 4 wherein said second frame includes a pair of transverse members extending respectively along the top of said bag and adjacent said fold line, and a pair of longitudinally extending members connected at their opposite ends to said transverse members.

6. A carrier accoridng to claim 5 wherein said transverse members adjacent said fold line are hingedly secured to said bag.

7. A carrier according to claim 6 wherein said members are hingedly secured by sections of fabric.

8. A carrier according to claim 6 wherein said members are hingedly secured to a rigid support on said bag.

9. A carrier according to claim 1 wherein said wheeled axle is provided with wheels positioned inwardly of said side members.

* * * * *